US005954988A

United States Patent [19]

Lee

[11] Patent Number: 5,954,988

[45] Date of Patent: Sep. 21, 1999

[54] HIGH VOLTAGE TRANSFORMER OF A MICROWAVE OVEN HAVING A STRUCTURE FOR RADIATING HEAT

[75] Inventor: Sung-ho Lee, Suwon, Rep. of Korea

[73] Assignee: Samsung Electronics Co., Ltd., Suwon-City, Rep. of Korea

[21] Appl. No.: 09/115,629

[22] Filed: Jul. 15, 1998

[30] Foreign Application Priority Data

Feb. 28, 1998 [KR] Rep. of Korea ..... 98-2817
Feb. 28, 1998 [KR] Rep. of Korea ..... 98-6654

[51] Int. Cl.[6] ..... H05B 6/80; H01F 27/08

[52] U.S. Cl. ..... 219/757; 219/760; 336/60

[58] Field of Search ..... 219/760, 757, 219/756; 336/60, 61, 59

[56] References Cited

U.S. PATENT DOCUMENTS 3,810,303 5/1974 Hoell ..... 336/60
4,746,425 5/1988 Stickler et al. ..... 336/61
4,858,095 8/1989 Narita et al. ..... 219/760
4,956,626 9/1990 Hoppe et al. ..... 336/60
5,164,626 11/1992 Oigawa ..... 336/61
5,660,749 8/1997 Taguchi et al. ..... 336/60

*Primary Examiner*—Philip H. Leung
*Attorney, Agent, or Firm*—Burns, Doane, Swecker & Mathis, L.L.P.

[57] ABSTRACT

A high voltage transformer of a microwave oven has a structure for radiating heat efficiently. The high voltage transformer comprises a core formed of a plurality of iron plates fixed together one after another, a coil wound on the core, and heat radiation fins disposed between the iron plates in such a manner that flange parts of the fins extend outwardly beyond an outer periphery of the core. The heat radiation fins are spaced from the iron plates so as not to be in contact with the iron plates, and are made of a high thermal conductivity material. Portions of the flange parts are bent to form air flow openings that conduct cooling air in close contact with the core.

2 Claims, 5 Drawing Sheets

HIGH VOLTAGE TRANSFORMER OF A MICROWAVE OVEN HAVING A STRUCTURE FOR RADIATING HEAT

BACKGROUND OF THE INVENTION

1. Field of the Invention

The present invention relates to a high voltage transformer, and more particularly, to a high voltage transformer of a microwave oven having a structure for radiating heat efficiently.

2. Description of the Prior Art

Generally, a high voltage transformer is a device for generating a certain degree of high voltage with a commonly used alternating current of 100V/220V input thereto. The high voltage transformer is essentially employed into home appliances such as a microwave oven which generates microwave to cook the foods, or the like, in order to supply the high voltage thereto.

FIG. 1 is a perspective view showing a conventional high voltage transformer. As shown, the conventional high voltage transformer is constructed in such a manner that a plurality of E-shaped or I-shaped iron plates 1*a* are fixed together one after another so as to form a rectangular core 1, and a coil 2 is wound many times at the center thereof.

An input terminal 3 is electrically connected with a side of the coil 2, while an output terminal 4 is electrically connected with the other side thereof. Therefore, when the commonly used alternating current (hereinafter AC) generally of 110V or 220V is input into the high voltage transformer through the input terminal 3, the high voltage transformer converts the AC power into the high voltage of predetermined value according to the winding ratio of the coil 2, and then outputs the high voltage through the output terminal 4.

In general, the high voltage output from the high voltage transformer is 2100~2400VAC. The high voltage is supplied to the components of the microwave oven such as a magnetron (not shown), a high voltage condenser (not shown), and a high voltage diode (not shown) to generate a microwave of a predetermined value of frequency.

When the conventional high voltage transformer operates, it generates a great amount of heat due to an inner resistance thereof, and the heat is radiated outside through the surface of the core 1.

In this situation, the inner resistance of the high voltage transformer is directly proportional to a length of the coil, while the inner resistance is inversely proportional to the sectional area of the coil. The coil should be long in order to generate the high voltage, so the inner resistance increases and thereby the transformer generates excessive heat.

Therefore, it is recommended that the circumference of the core 1 should be as large as possible so that the surface contacted with the air is large enough to keep the temperature thereof within a range of safety.

Additionally, for the efficient heat radiation, a blowing fan (not shown) is installed near the high voltage transformer. The blowing fan blows outside air in force to cool the high voltage transformer.

However, since the conventional high voltage transformer has to be large so as to radiate its own heat, the volume and the weight thereof are also quite large. This causes an inconvenience to a user who has to handle the high voltage transformer of generally 3.5~5.5 kg. Also, the manufacturing cost increases. Therefore, there is a great demand for the small and light high voltage transformer, which will solve the problems of the inconvenience and the large sum of manufacturing cost.

SUMMARY OF THE INVENTION

The present invention has been made to overcome the above problems, and accordingly, it is an object of the present invention to provide a high voltage transformer of a microwave oven which has an increased heat radiation efficiency and thereby is light and small.

To accomplish above object, the present invention provides a high voltage transformer of a microwave oven comprising: a core formed by a plurality of iron plates which are fixed together; a coil wound on said core many times, said coil generating a high voltage of a predetermined value; and at least one heat radiation fin disposed between said iron plates in such a manner that flange parts thereof are exposed out to a periphery of said core.

It is preferable that said heat radiation fins are spaced at a predetermined interval with said iron plates so as not to be in contact with said iron plates, and are made of aluminum of high thermal conductivity.

According to the high voltage transformer having a structure for radiating heat based on the preferred embodiments as described above, the heat radiation efficiency thereof is improved, thereby, it can be a smaller sized and lighter weighed one compared with the other ones having the same heat radiation efficiency.

BRIEF DESCRIPTION OF THE DRAWINGS

The above object and advantages will be more apparent by describing the preferred embodiment in greater detail with reference to the drawings accompanied, in which.

DETAILED DESCRIPTION OF THE PREFERRED EMBODIMENT

Figure 1:
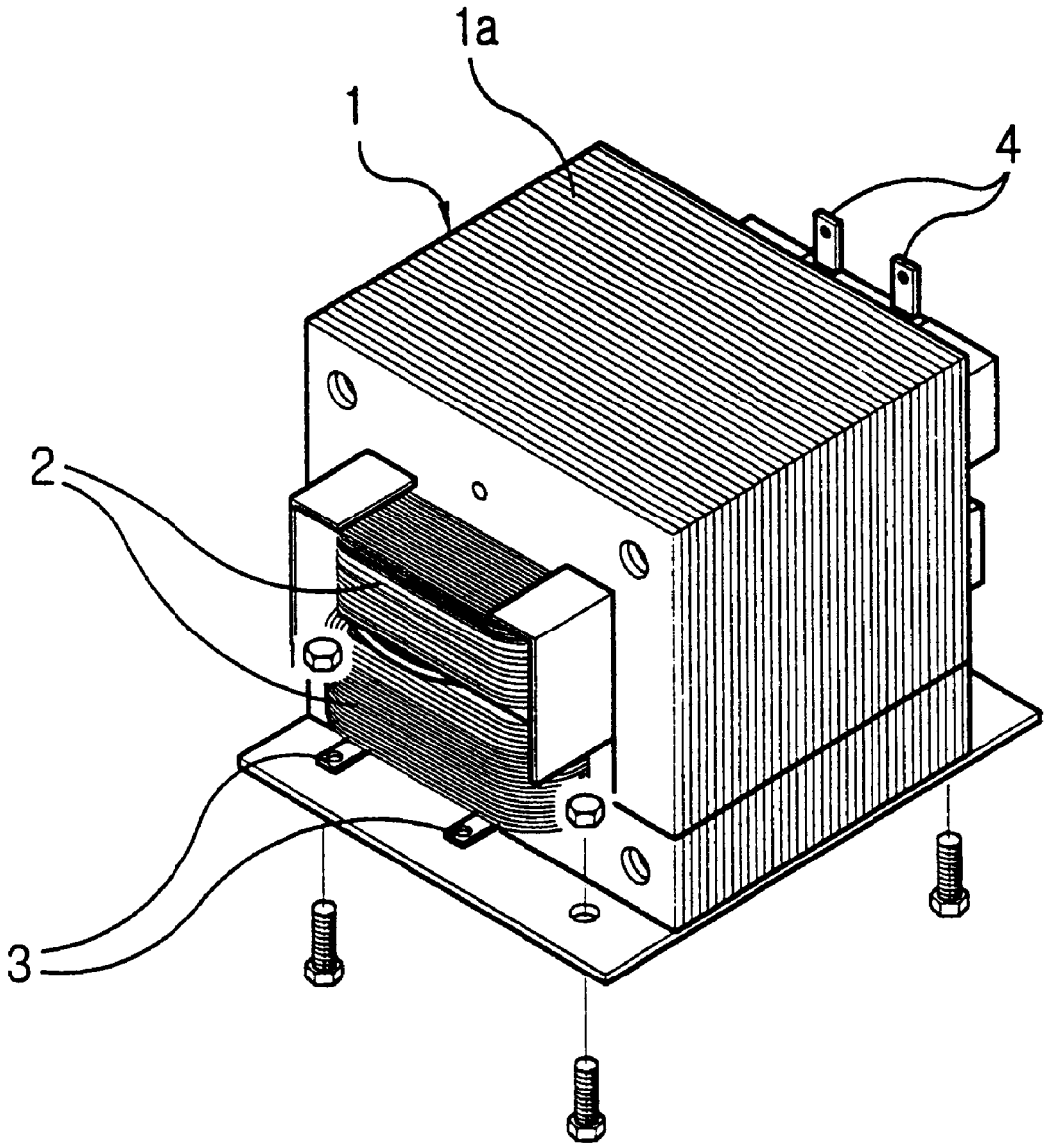
FIG. 1 (PRIOR ART)
FIG. 1 is a perspective view of a conventional high voltage transformer.
Figure 2:
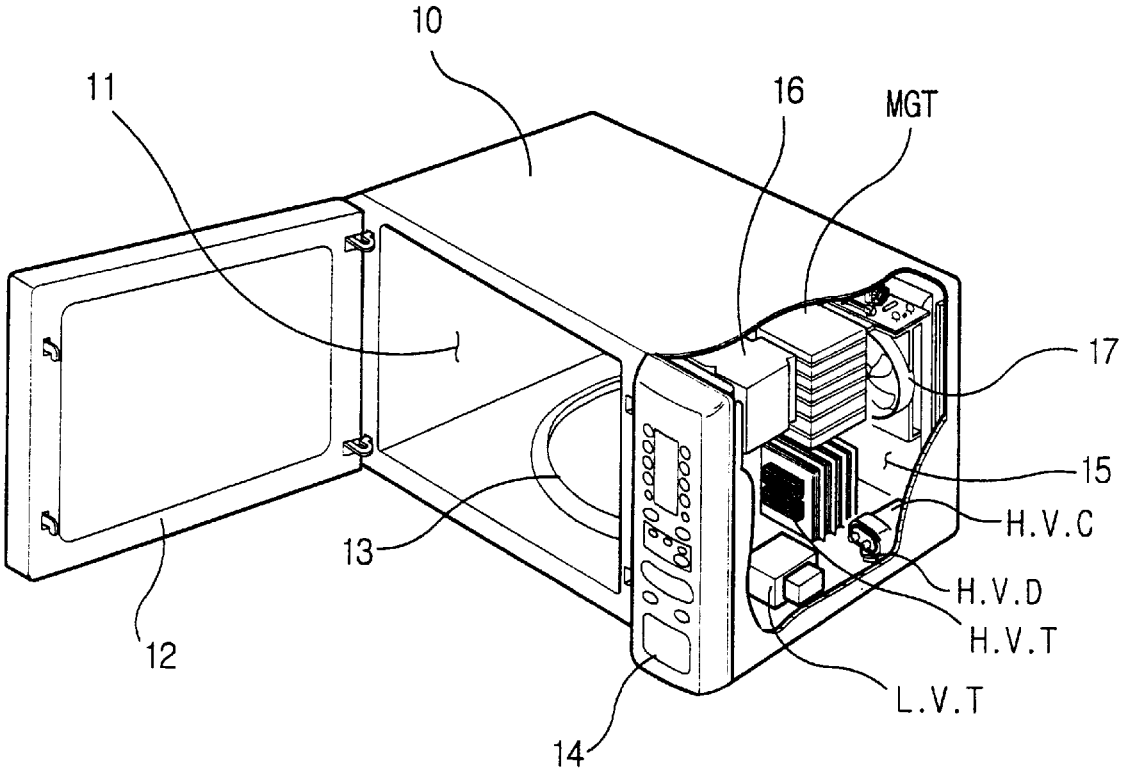
FIG. 2 is a perspective view showing a microwave oven employing a high voltage transformer according to the present invention.
Figure 3:
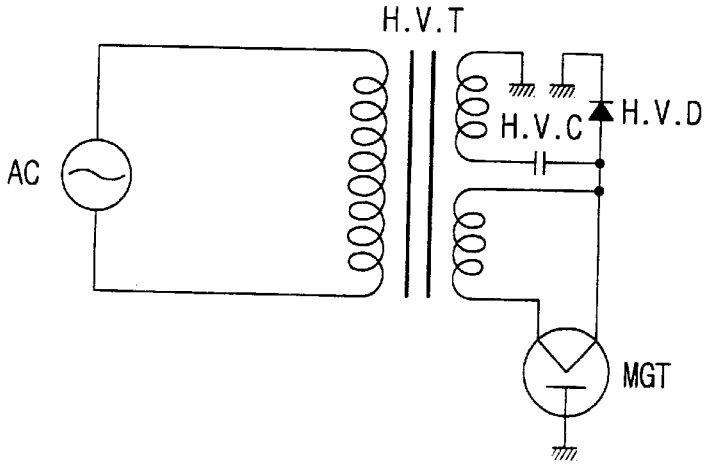
FIG. 3 is a circuit diagram of a high voltage part of FIG. 2.

FIG. 2 is a perspective view showing a microwave oven having a high voltage transformer according to the present invention; and FIG. 3 is a circuit diagram of the high voltage part of FIG. 2.

According to FIG. 2, a cabinet 10 forming the appearance of a microwave oven has a cooking cavity 11 of which a front side is open, and a device chamber 15 which has circuit devices.

Also, a door 12 for opening/closing the open side of the cooking cavity 11 is installed, and a rotating tray 13 for loading the food to be cooked is rotatably installed at the bottom thereof. A motor and gears (not shown in the drawings) for rotating the rotating tray 13 are installed at the lower side of the rotating tray 13.

In the device chamber 15, a magnetron MGT for generating microwaves, a high voltage transformer H.V.T, a high voltage condenser H.V.C, a high voltage diode H.V.D., and a blowing fan 17 which are connected electrically with each other are installed.

The blowing fan 17 blows air in force so as to cool the magnetron MGT. The air heated by the cooling operation of the magnetron MGT is guided into the cavity chamber 11 through an air guide 16 provided at a side of the cabinet 10.

Further, the blowing fan 17 also cools all the other electric devices such as a high voltage transformer H.V.T, a low voltage transformer L.V.T, a high voltage condenser H.V.C, a high voltage diode H.V.D and the like.

According to FIG. 3, the high voltage transformer H.V.T. receives the commonly used AC power through a first coil thereof, and then outputs a high voltage of a predetermined value through a second coil thereof. The high voltage output from the high voltage transformer H.V.T is doubled by the high voltage condenser H.V.C and high voltage diode H.V.D, and then supplied to the magnetron MGT. The magnetron MGT generates microwave of 2450MHz and supplies it into the cooking cavity 11.

Figure 4:
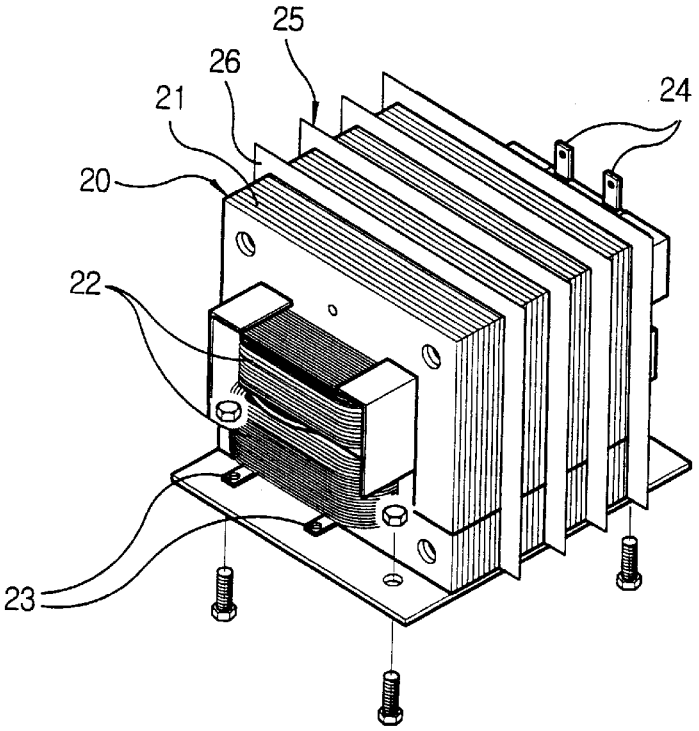
FIG. 4 is a perspective view showing a high voltage transformer having a heat radiation structure based on a preferred embodiment of the present invention.
Figure 5:
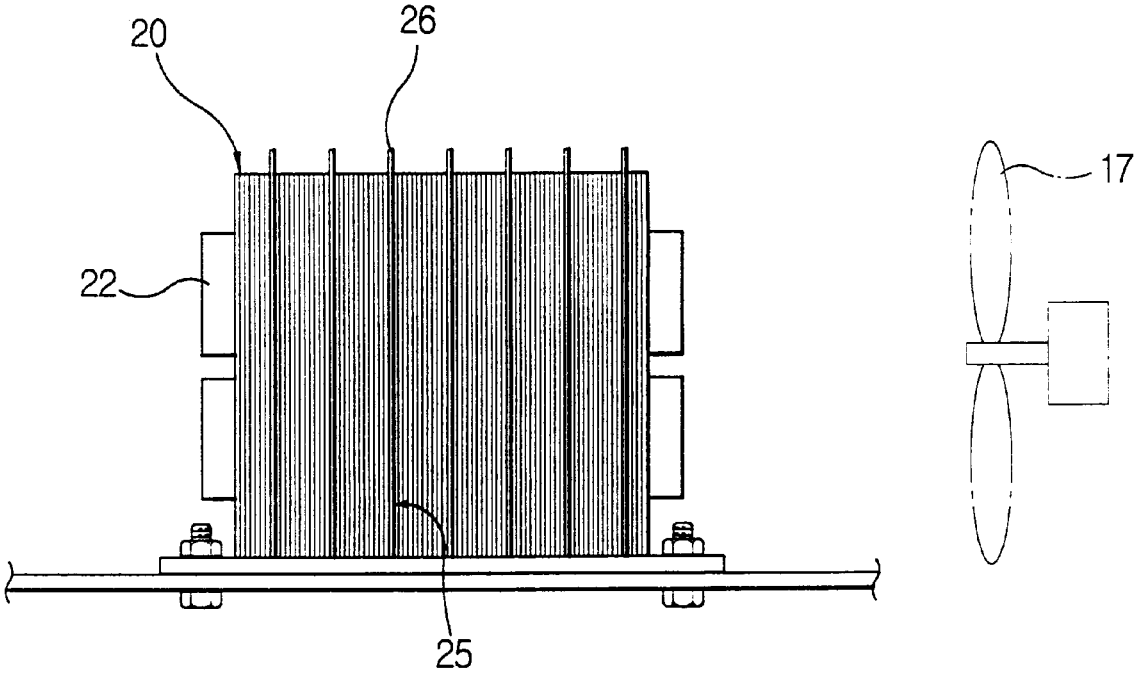
FIG. 5 is a side view of main part of FIG. 4.

FIGS. 4 and 5 show high voltage transformers of microwave oven having a structure for radiating heat according to the preferred embodiment of the present invention.

The high voltage transformer in present invention is constructed in such a manner that a plurality of E-shaped or I-shaped iron plates 21 are fixed together so as to form a rectangular core 20, and a coil 2 is wound many times at the center thereof.

Also, at least one heat radiation fin 25 is between the iron plates 21.

In this situation, flange parts 26 of the heat radiation extend outwardly beyond the outer periphery of the core 20. Accordingly, the sectional area of the core 20, i.e., the area contacting with the air becomes larger, and thereby the efficiency of a cooling operation of the blowing fan 17 is more enhanced.

More specifically, radiation fins 25 are disposed in such a manner that they are spaced from the iron plates 21 at a predetermined interval between the iron plates 21. Preferably, the heat radiation fins 25 are made of silicon steel which is commonly used as a material for the iron plates 21, or they can be made of aluminum of high thermal conductivity.

An input terminal 23 is electrically connected to a side of the coil 22, while an output terminal 24 is electrically connected to the other. And the way they are constructed is similar as described above.

Figure 6:
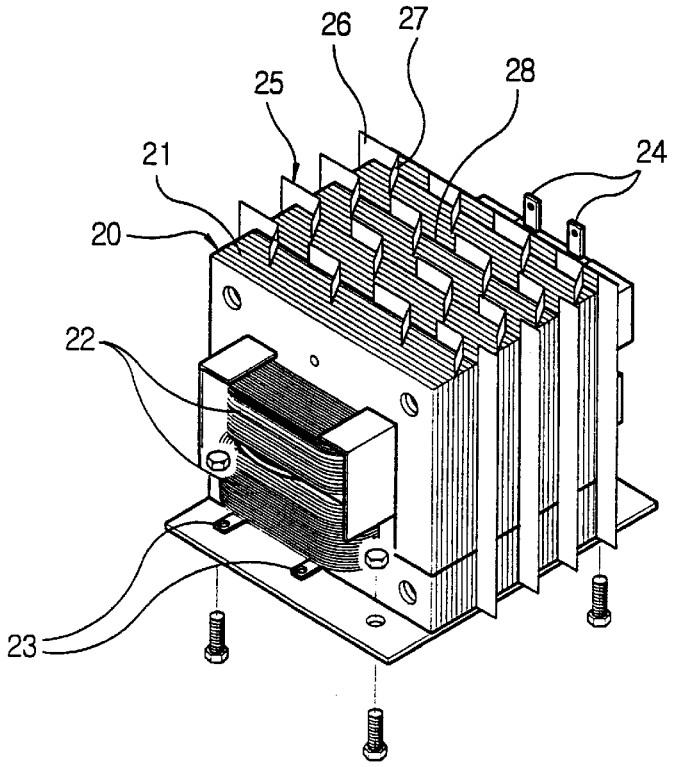
FIG. 6 is a perspective view showing a high voltage transformer having a heat radiation structure based on another preferred embodiment of the present invention.
Figure 7:
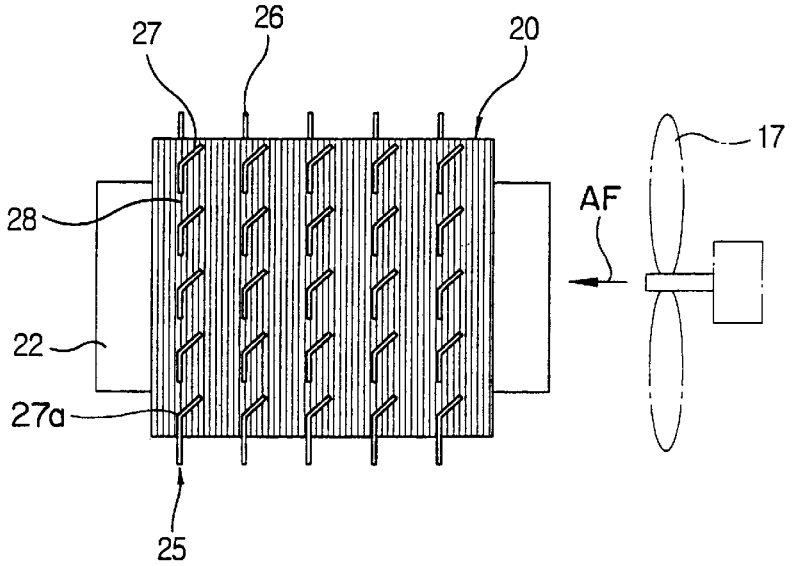
FIG. 7 is a side view of main part of FIG. 6.

FIGS. 6 and 7 show a high voltage transformer of a microwave oven having a structure for radiating heat according to another preferred embodiment of the present invention.

As shown, the high voltage transformer H.V.T based on another preferred embodiment further includes a plurality of bent portions 27 which are bent about bend lines 26*a* extending transversely of a direction of air flow AF to form a plurality of air flow openings 28 at the upper flanges 26 of the heat radiation fins 25. In this situation, the bent portions 27 are bent toward (i.e., opposite to) the blowing direction AF of the air.

According to another preferred embodiment constructed as above, which is similar to what is shown in FIG. 2, as the door 12 is opened, the cooking vessel with food therein is received into the cooking cavity 11 through the front of the cabinet 10. Then the cooking vessel is positioned on the rotating tray 13.

Then, the microwave oven is operated in a state that the door 12 thereof is closed. The AC power is boosted in the high voltage transformer H.V.T, and doubled by the high voltage condenser H.V.C and the high voltage diode H.V.D. The boosted high voltage (usually of about 2100~2400VAC) is supplied to the magnetron MGT, and then the magnetron MGT generates microwave of 2450MHz. The microwave is guided into the cooking cavity 11.

Furthermore, the AC power is also supplied to the other load circuit (not shown) through the low voltage transformer L.V.T. Subsequently, the rotating tray 13 is rotated by the other load circuit at the same time that the microwave is projected into the cooking cavity 11, whereby the cooking process is performed.

Meanwhile, the inner resistance of the high voltage transformer H.V.T is directly proportional to the length of the first and second coil 22, as shown in FIG. 3. Therefore, in order to generate the higher voltage, the coil 22 should be long, whereby the inner resistance is increased and the excessive heat is generated from the high voltage transformer H.V.T.

Since the area contacting with the ambient air becomes large by the surface of the core 20 and the flange parts 26 of the heat radiation fins 25 extend outwardly beyond the outer periphery of the core 20, the efficiency for radiating heat is substantially enhanced.

In addition, when the blowing fan 17 blows air toward the high voltage transformer H.V.T in order to radiate the heat thereof, the air is blown between the flange parts 26, which enhances the heat radiation efficiency much more.

And more preferably, as shown in FIGS. 6 and 7 based on another preferred embodiment, when the air is blown by the blowing fan 17 toward the high voltage transformer H.V.T, the flowing direction of the air blown between the flange parts 26 is varied. That is, due to a plurality of the bent portions 27 of the flange parts 26 and open parts 28, the air is much more contacted with the surface of the core 20, and thereby the heat radiation efficiency is much more enhanced.

According to the high voltage transformer having a structure for radiating heat based on the preferred embodiments as described above, the heat radiation efficiency thereof is improved, thereby, it can be a smaller sized and lighter weighed one compared with the other ones having the same heat radiation efficiency.

There are additional advantages such as convenience of handling, and decrease in manufacturing cost due to a reduced quantity of components.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven including a high voltage transformer and a fan for directing air toward the transformer in a direction of air flow; the transformer comprising:

a core formed by a plurality of parallel iron plates which are fixed together one after another;

a coil wound on the core for generating a high voltage of a predetermined value;

and at least one heat radiation fin disposed between the iron plates in such a manner that the fin extends outwardly beyond an outer periphery of the core, whereby the fin forms an outwardly exposed flange part, the exposed flange part including bent portions bent about respective bend lines extending transversely of the direction of air flow, the bent portions being bent about the respective bend lines in a direction opposite the direction of air flow, the bent portions forming interruptions along the exposed flange part, the interruptions defining air flow openings.

2. The microwave oven according to claim 1 wherein there is a plurality of the heat radiation fins, the fins disposed between respective pairs of the iron plates.

* * * * *